US006575710B2

(12) United States Patent
Wallis

(10) Patent No.: US 6,575,710 B2
(45) Date of Patent: Jun. 10, 2003

(54) COMPRESSOR WITH BLOCKED SUCTION CAPACITY MODULATION

(75) Inventor: Frank S. Wallis, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/915,798

(22) Filed: Jul. 26, 2001

(65) Prior Publication Data

US 2003/0021703 A1 Jan. 30, 2003

(51) Int. Cl.[7] ..... F04B 49/00
(52) U.S. Cl. ..... 417/298; 417/213; 417/307
(58) Field of Search ..... 417/298, 286, 417/278, 279, 295, 299, 282, 213, 307, 454

(56) References Cited

U.S. PATENT DOCUMENTS 3,119,550 A * 1/1964 West et al. ..... 230/2
3,303,988 A * 2/1967 Weatherhead ..... 230/31
3,578,883 A * 5/1971 Cheney ..... 417/286
3,844,686 A * 10/1974 Le Blanc ..... 417/298
4,432,705 A * 2/1984 Fraser et al. ..... 417/295

OTHER PUBLICATIONS

OGD/E Application Guide by Carlyle Compressor Company Lit. No. 574–069, Rev. A. 8/98—48 pages.

* cited by examiner

*Primary Examiner*—Charles G. Freay
*Assistant Examiner*—Han L. Liu
(74) *Attorney, Agent, or Firm*—Harness, Dickey & Pierce, P.L.C.

(57) ABSTRACT

A capacity control system has a valve which closes off the inlet to one or more of the cylinders in a multicylinder compressor. The valve is motivated by fluid at discharge pressure which reacts against a piston to close the inlet. An orifice is positioned in the flow of the fluid at discharge pressure to control the velocity of the piston to reduce impact loading and improve reliability.

32 Claims, 5 Drawing Sheets

COMPRESSOR WITH BLOCKED SUCTION CAPACITY MODULATION

FIELD OF THE INVENTION

The present invention relates generally to refrigeration compressors. More particularly, the present invention relates to a reciprocating piston type refrigeration compressor which incorporates capacity modulation by utilization of blocked suction.

BACKGROUND AND SUMMARY OF THE INVENTION

Refrigeration and air conditioning systems are commonly operated under a wide range of loading conditions due to changing environmental conditions. In order to effectively and efficiently accomplish the desired cooling under these changing conditions, it is advantageous to incorporate a system which varies the capacity of the refrigeration compressor in the system.

A wide variety of systems have been developed in order to accomplish capacity modulation. The various types of unloading and capacity control found in the prior art for refrigeration compressors all have been subject to various drawbacks and/or durability issues. Some of these prior art systems have operated satisfactorily but they have required a substantial amount of external tubing or other components which are subject to damage during shipping and/or possible accidental damage after installation. In addition, the field labor required in the installation and maintenance of these external systems is subject to error which creates problems during actual operation and increases the field labor costs.

Other designs for capacity modulation systems are installed during the manufacture of the compressor. These designs have all of the major components internal to the compressor itself except for a single component which is typically the only element to require servicing during the expectable life of the compressor. This single external component is constructed such that it is easily accessible for service while still being positioned to limit the danger of accidental damage.

While the prior art internal systems have proven to operate satisfactorily, there is still a need to improve both the reliability and durability of these capacity modulation systems.

The present invention provides the art with a capacity modulation system which utilizes a piston for blocking the suction inlet to reduce the capacity of the compressor. The high-pressure gas which is supplied to the piston during activation is throttled in order to reduce the piston impact velocity. The reduction in the piston impact velocity improves the reliability and durability of the piston, the piston seals and the piston seat.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
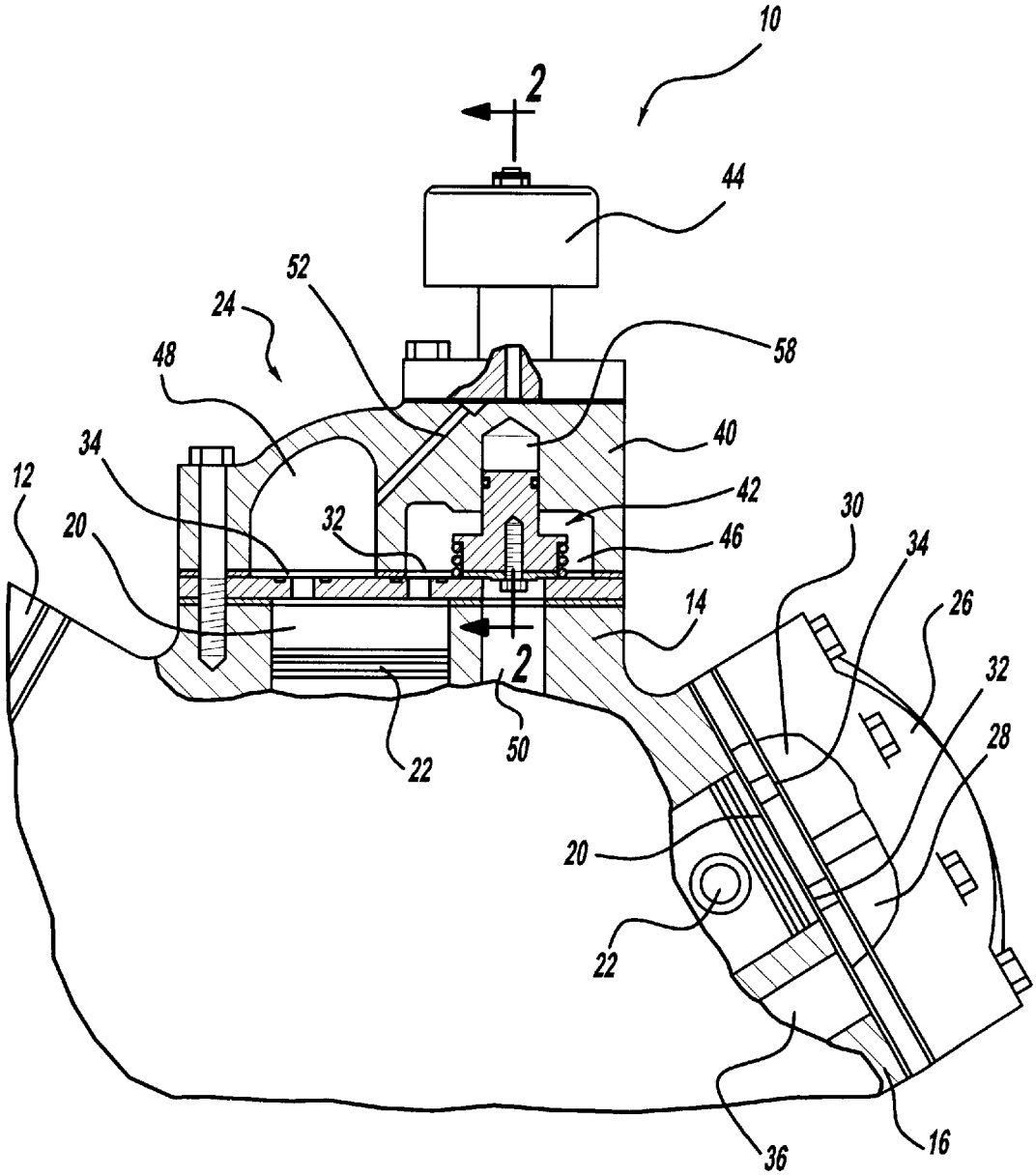
FIG. 1 is a fragmentary partially sectioned end elevational view of a three-bank radial reciprocating compressor incorporating the capacity modulation system in accordance with the present invention.

Referring now to the drawings in which like reference numerals designate like or corresponding parts throughout the several views, there is shown in FIG. 1 a body or cylinder block portion of a multicylinder refrigeration compressor in accordance with the present invention and which is designated generally by the reference numeral 10. Compressor 10 illustrates three cylindrical banks 12, 14 and 16. Although only cylindrical banks 14 and 16 are illustrated, it is to be understood that each cylinder bank may contain one, two or more cylinders and that the construction illustrated typifies known commercial practice and is merely illustrative insofar as the compressor itself is concerned.

Each cylinder bank 12, 14 and 16 defines a compression cylinder 20 within which a piston 22 is slidingly disposed. Cylinder bank 14 is illustrated with a capacity control system 24 while cylinder bank 16 is illustrated without capacity control system 24. As detailed below, one or more of cylinder banks 12, 14 and 16 may include capacity control system 24. Cylinder bank 16 includes a cylinder head 26 which closes cylinder 20 and which defines a suction chamber 28 and a discharge chamber 30. A suction valve 32 controls the communication between suction chamber 28 and cylinder 20 and a discharge valve 34 controls the communication between discharge chamber 30 and cylinder 20. A suction passage 36 extends between suction chamber 28 and a common suction chamber (not shown) of compressor 10 which is in turn open to the inlet of the compressor. Discharge chamber 30 is in communication with the outlet of compressor 10 through a discharge passage (not shown).

Figure 2:
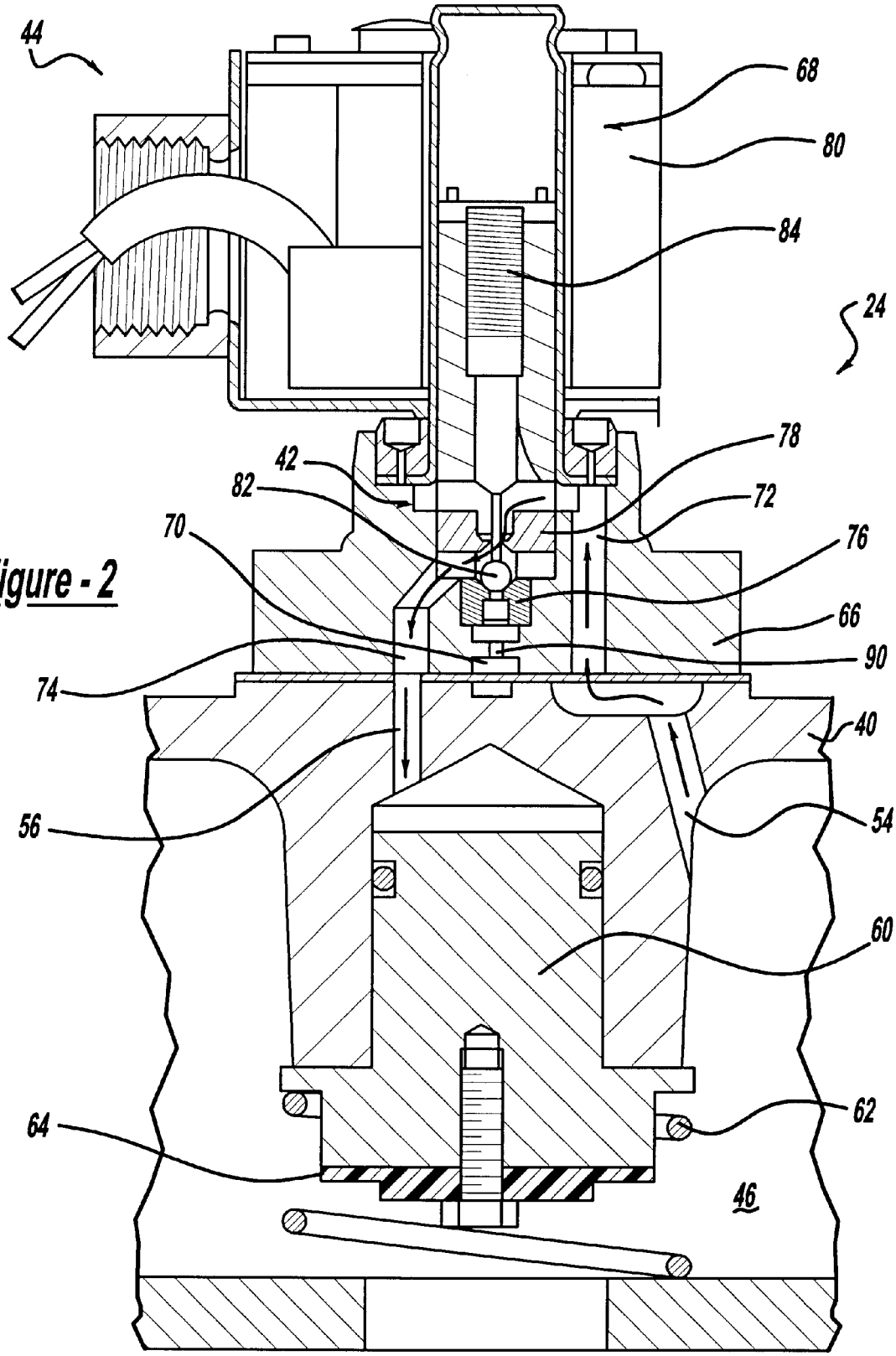
FIG. 2 is an enlarged cross-sectional view of the internal unloader valve shown in FIG. 1 in a full capacity position.

Referring now to FIGS. 1 and 2, cylinder bank 14 is illustrated incorporating capacity control system 24. Capacity control system 24 comprises a cylinder head 40, a control piston assembly 42 and a solenoid valve assembly 44. Cylinder head 40 closes cylinder 20 and it defines a suction chamber 46 and a discharge chamber 48. A suction valve 32 controls the communication between suction chamber 46 and cylinder 20 and a discharge valve 34 controls the communication between discharge chamber 48 and cylinder 20. A suction passage 50 extends between suction chamber 46 and the common suction chamber of compressor 10. Discharge chamber 30 is in communication with the outlet of compressor 10 through a discharge passage (not shown). Cylinder head 40 defines a discharge pressure passage 52 which extends between discharge chamber 48 and solenoid valve assembly 44, a suction pressure passage 54 (FIG. 2) which extends between suction chamber 46 and solenoid valve assembly 44 and a control passage 56 which extends between solenoid valve assembly 44 and a control chamber 58 defined by cylinder head 40.

Control piston assembly 42 is slidingly disposed within control chamber 58 and it comprises a valve body or piston 60 and a biasing spring 62. Piston 60 is slidingly disposed within control chamber 58 with a seal disposed between piston 60 and control chamber 58. Biasing spring 62 is disposed between piston 60 and cylinder bank 14 with a seal 64 attached to piston 60. Seal 64 engages cylinder bank 14 to block suction passage 50 when piston assembly 42 is in its closed position. Biasing spring 62 urges piston assembly 42 into an open position.

Solenoid valve assembly 44 comprises a valve block 66 and a solenoid valve 68. Valve block 66 is secured to cylinder head 40 and it defines a discharge control passage 70 in communication with discharge pressure passage 52, a suction control passage 72 in communication with suction pressure passage 54 and a common control passage 74 in communication with control passage 56. A discharge valve seat 76 is disposed between discharge control passage 70 and common control passage 74 and a suction valve seat 78 is disposed between suction control passage 72 and common control passage 74.

Solenoid valve 68 includes a solenoid coil 80 and a needle valve 82. Needle valve 82 is disposed between valve seats 76 and 78 and moves between a first position and a second position. In its first position, communication between discharge control passage 70 and common control passage 74 is blocked but communication between suction control passage 72 and common control passage 74 is permitted. In its second position, communication between discharge control passage 70 and common control passage 74 is permitted but communication between suction control passage 72 and common control passage 74 is prohibited. Needle valve 82 and thus solenoid valve 68 is normally biased into its first position by a biasing member 84 which allows full capacity for compressor 10. Activation of solenoid coil 80 moves needle valve 82 and thus solenoid valve 68 to its second position which results in operation of compressor 10 at a reduced capacity.

Referring now to FIG. 2, capacity control system 24 is illustrated in its full capacity or first position. In this position, solenoid coil 80 is de-energized and needle valve 82 is biased against discharge valve seat 76. The biasing of needle valve 82 against discharge valve seat 76 closes discharge control passage 70 and opens suction control passage 72. Thus, control chamber 58 is in communication with the common suction chamber of compressor 10 through common control passage 74, suction valve seat 78, suction control passage 72 and suction pressure passage 54. Fluid at suction pressure reacts against both the upper and lower surfaces of piston 60 and piston 60 is urged away from cylinder bank 14 by biasing spring 62. The movement of piston 60 away from cylinder bank 14 places suction passage 50 in communication with suction chamber 46 allowing for the free flow of suction gas and the full capacity operation of cylinder bank 14.

Figure 3:
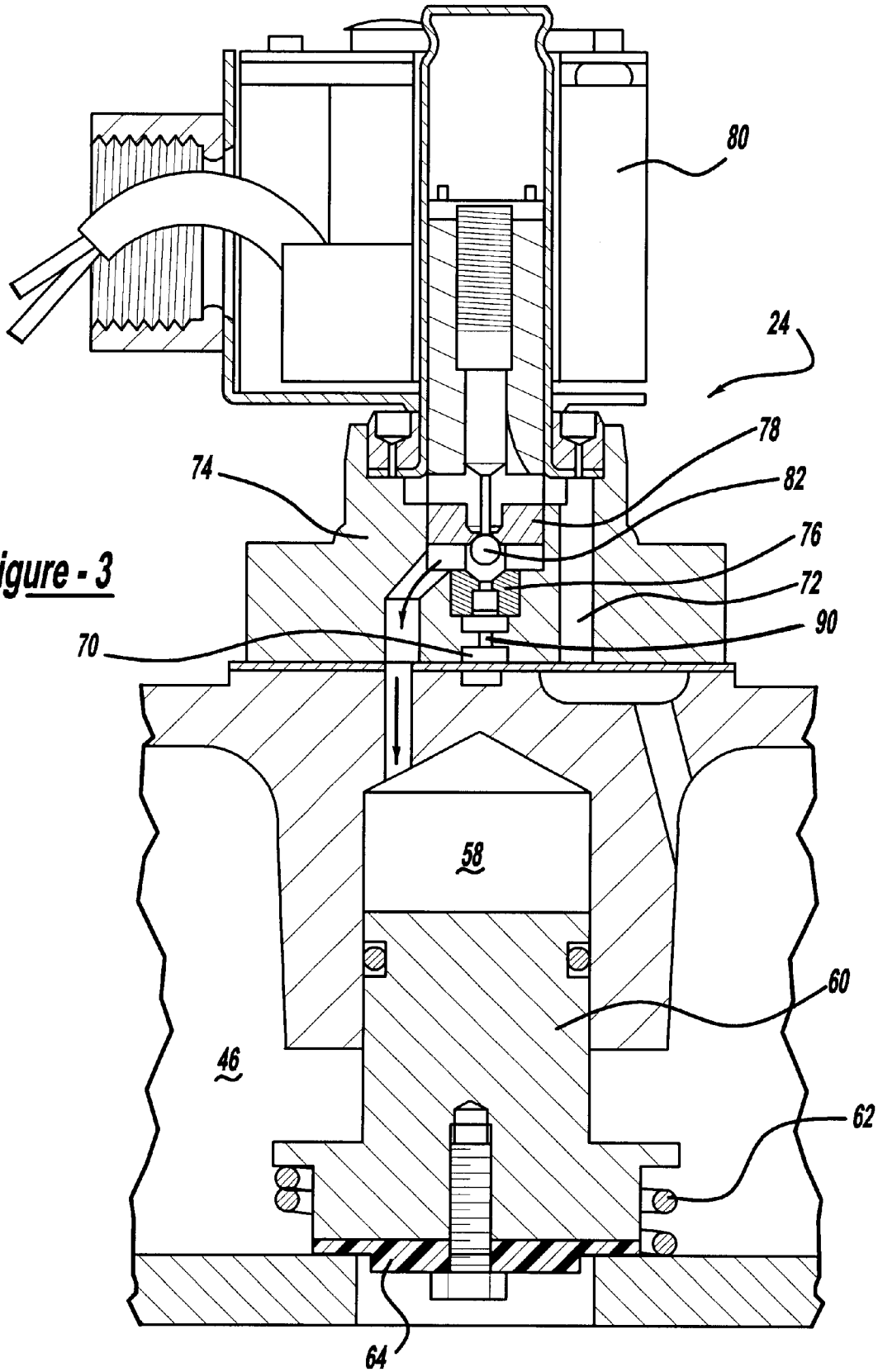
FIG. 3 is an enlarged cross-sectional view of the internal unloader valve shown in FIG. 2 with the unloader valve in a reduced capacity position.

Referring now to FIG. 3, capacity control system 24 is illustrated in its reduced capacity or second position. In this position, solenoid coil 80 is energized and needle valve 82 is biased against suction valve seat 78. The biasing of needle valve 82 against suction valve seat 78 closes suction control passage 72 and opens discharge control passage 70. Thus, control chamber 58 is in communication with discharge pressure from the outlet of compressor 10 through common control passage 74, discharge valve seat 76, discharge control passage 70 and discharge pressure passage 52. Fluid at discharge pressure reacts against the upper surface of piston 60 to urge piston 60 into engagement with cylinder bank 14 against the force produced by biasing spring 62. The engagement of piston 60 and seal 64 with cylinder bank 14 closes suction passage 50 which blocks fluid at suction pressure from entering suction chamber 46. The capacity of cylinder bank 14 is essentially reduced to zero. Discharge control passage 70 is provided with an orifice 90 which limits the flow of fluid at discharge pressure from control passage 70 to control chamber 58. By limiting the flow of fluid at discharge pressure into control chamber 58, the velocity of piston 60 is reduced which then diminishes the impact force between piston 60 and cylinder bank 14. The diminishing of the impact force reduces damage and wear on piston 60, seal 64 and the seat on cylinder bank 14. This, in turn, significantly improves the reliability of compressor 10.

In the preferred embodiment, piston 60 has a diameter of approximately one inch and a stroke of approximately 0.310 inches. With these dimensions, the preferred diameter for orifice 90 is between 0.020 inches and 0.060 inches and more preferably between 0.030 inches and 0.050 inches.

The above data can be used to calculate the following list of values using well known equations:

| | Piston | "Preferred" Orifice Range | "More Preferred" |
|---|---|---|---|
| Diameter (in) | 1.000 | 0.020 to 0.060 | 0.030 to 0.050 |
| Cross-Sectional area ($in^2$) | 0.785 | 0.000314 to 0.00283 | 0.000707 to 0.00196 |
| Stroke (in) | 0.310 | Na | Na |
| Displacement ($in^2$) | 0.243 | Na | Na |
| Ratio of piston to orifice diameters | Na | 50.0:1 to 16.7:1 | 33.3:1 to 20.0:1 |
| Ratio of piston to orifice diameters | Na | 2500:1 to 277:1 | 1110:1 to 401:1 |
| Ratio of piston displacement to orifice diameters | Na | 12.2:1 to 4.05:1 | 8.1:1 to 4.86:1 |
| Ratio of piston displacement to orifice area | Na | 77.4:1 to 85.9:1 | 344:1 to 124:1 |

While the present invention is described as having only cylinder bank 14 incorporating capacity control system 24, it is within the scope of the present invention to include capacity control system 24 on more than one cylinder bank but not all of the cylinder blocks because discharge pressurized fluid is required for the movement of piston 60. With the present invention having three cylinder banks, the incorporation of one capacity control system allows the capacity of compressor 10 to vary between ⅔ capacity and full capacity. The incorporation of two capacity control systems 24 allows the capacity of compressor 10 to vary between ⅓ capacity and full capacity.

Solenoid coil 80 is described as being de-energized to place needle valve 82 in a first position which provides full capacity and as being energized to place needle valve 82 in a second position which provides reduced capacity. It is within the scope of the present invention to operate solenoid coil 80 in a pulsed width modulation mode in order to provide an infinitesimal number of capacities between the fully reduced capacity and the full capacity. In this manner and by incorporating capacity control system 24 on two of the cylinder blocks, the capacity of compressor 10 can be selected at any capacity between ⅓ capacity and full capacity.

Figure 4:
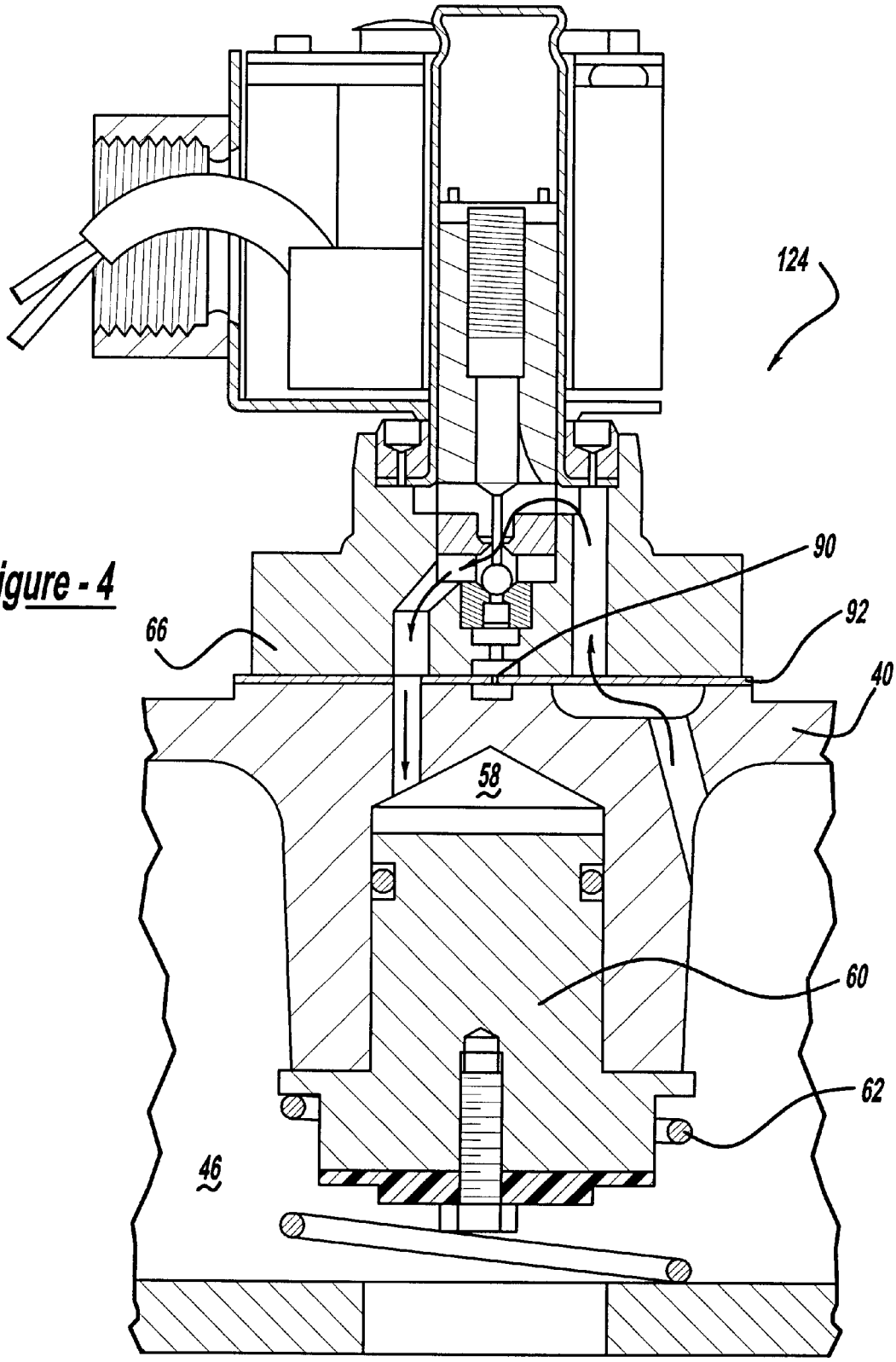
FIG. 4 is an enlarged cross-sectional view of an internal unloader valve in accordance with another embodiment of the present invention with the unloader valve in a full capacity position.
Figure 5:
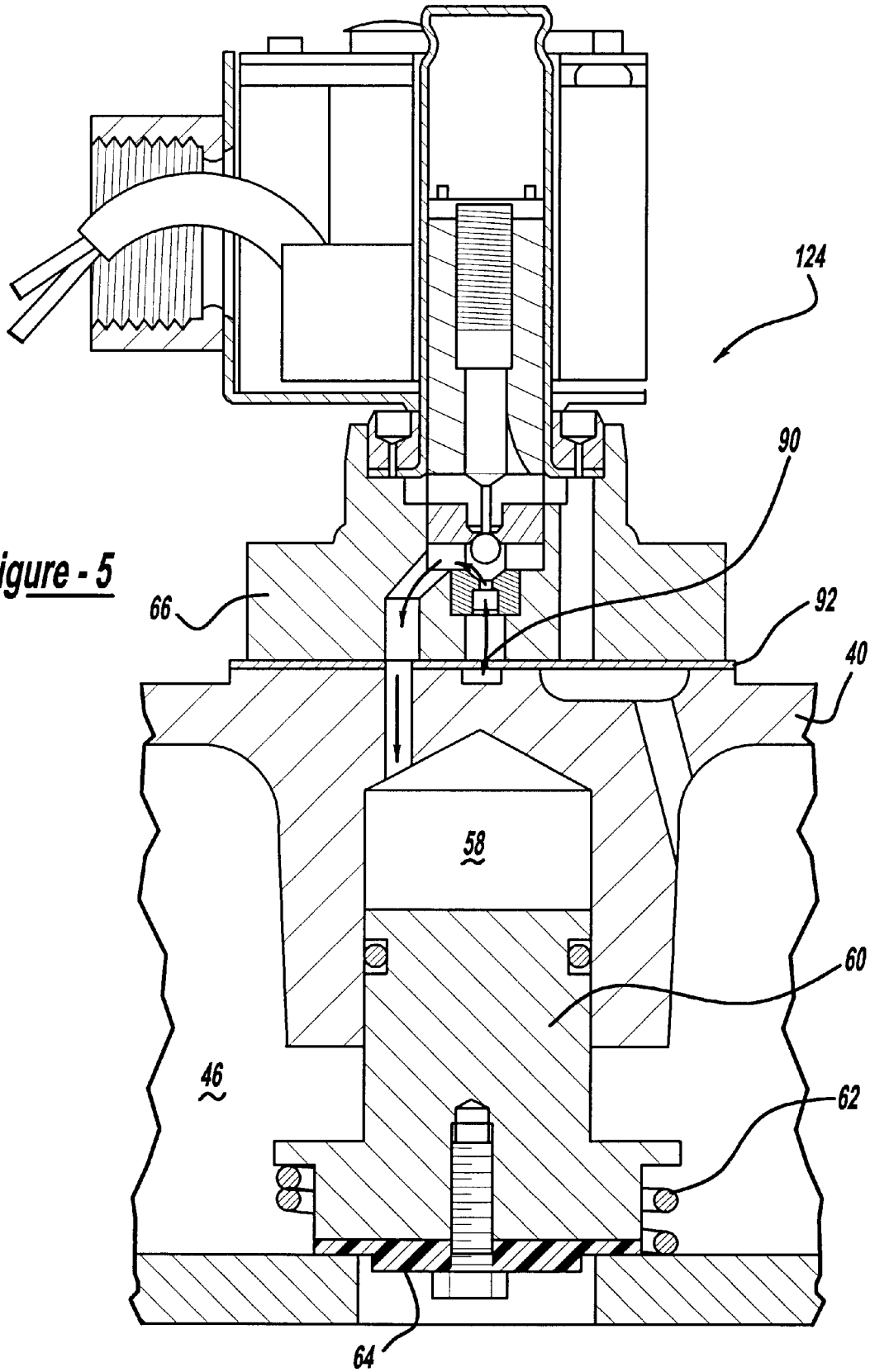
FIG. 5 is an enlarged cross-sectional view of the internal unloader valve shown in FIG. 4 with the unloader valve in a reduced capacity position.

Referring now to FIGS. 4 and 5, a capacity control system 124 is illustrated. Capacity control system 124 is the same as capacity control system 24 except that orifice 90 has been relocated from discharge control passage 70 to a gasket 92 disposed between cylinder head 40 and valve block 66. The operation and function of capacity control system 124 is identical to that described above for capacity control system 24. FIG. 4 illustrates capacity control system 124 at full capacity and FIG. 5 illustrates capacity control system 124 at reduced capacity.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein said capacity control system further comprises a cylinder head, a valve block and a gasket; said cylinder head being secured to said cylinder bank and defining said control chamber, said valve block being secured to said cylinder head, said gasket being disposed between said cylinder head and said valve block, said orifice being defined by said gasket.

2. The compressor according to claim 1, further comprising a solenoid valve for opening said first valve.

3. The compressor according to claim 2, wherein said solenoid valve opens said second valve.

4. The compressor according to claim 1, wherein said first valve is open when said second valve is closed and said first valve is closed when said second valve is open.

5. The compressor according to claim 1, further comprising a biasing member for urging said first valve into said open position.

6. The compressor according to claim 5, wherein said biasing member urges said second valve into said closed position.

7. The compressor according to claim 1, further comprising a biasing member for urging said valve body into said first position.

8. The compressor according to claim 1, wherein said first and second valves include a common needle valve.

9. A compressor as claimed in claim 1 wherein the ratio of said piston to orifice diameters ranges between 50.0:1 and 16.7:1.

10. A compressor as claimed in claim 1 wherein the ratio of said piston to orifice diameters ranges between 33.3:1 and 20.0:1.

11. A compressor as claimed in claim 1 wherein the ratio of said piston to orifice areas ranges between 2500:1 and 277:1.

12. A compressor as claimed in claim 1 wherein the ratio of said piston to orifice areas ranges between 1110:1 and 401:1.

13. A compressor as claimed in claim 1 wherein the ratio of said piston displacement to orifice diameter ranges between 12.2:1 and 4.05:1.

14. A compressor as claimed in claim 1 wherein the ratio of said piston displacement to orifice diameter ranges between 8.1:1 and 4.86:1.

15. A compressor as claimed in claim 1 wherein the ratio of said piston displacement to orifice area ranges between 77.4:1 and 85.9:1.

16. A compressor as claimed in claim 1 wherein the ratio of said piston displacement to orifice area ranges between 344:1 and 124:1.

17. A compressor as claimed in claim 1 wherein said piston has a diameter of approximately 1.0 inches and the diameter of said orifice ranges between 0.020 inches and 0.060 inches.

18. A compressor as claimed in claim 1 wherein said piston has a diameter of approximately 1.0 inches and the diameter of said orifice ranges between 0.030 inches and 0.050 inches.

19. A compressor as claimed in claim 1 wherein said piston has a displacement of approximately 0.243 cubic inches and the diameter of said orifice ranges between 0.020 and 0.060 inches.

20. A compressor as claimed in claim 1 wherein said piston has a displacement of approximately 0.243 cubic inches and the diameter of said orifice ranges between 0.030 and 0.050 inches.

21. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein the ratio of said piston to orifice diameters ranges between 50.0:1 and 16.7:1.

22. A compressor as claimed in claim 21 wherein the ratio of said piston to orifice diameters ranges between 33.3:1 and 20.0:1.

23. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein the ratio of said piston to orifice areas ranges between 2500:1 and 277:1.

24. A compressor as claimed in claim 23 wherein the ratio of said piston to orifice areas ranges between 1110:1 and 401:1.

25. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein the ratio of said piston displacement to orifice diameter ranges between 12.2:1 and 4.05:1.

26. A compressor as claimed in claim 25 wherein the ratio of said piston displacement to orifice diameter ranges between 8.1:1 and 4.86:1.

27. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein the ratio of said piston displacement to orifice area ranges between 77.4:1 and 85.9:1.

28. A compressor as claimed in claim 27 wherein the ratio of said piston displacement to orifice area ranges between 344:1 and 124:1.

29. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open when said valve body is in said second position; and an orifice disposed between said discharge chamber and said control chamber, said orifice limiting the flow of fluid between said discharge chamber and said control chamber to limit velocity of said valve body;

wherein said piston has a diameter of approximately 1.0 inches and the diameter of said orifice ranges between 0.020 inches and 0.060 inches.

30. A compressor as claimed in claim 29 wherein the diameter of said orifice ranges between 0.030 inches and 0.050 inches.

31. A compressor having an inlet and an outlet, said compressor comprising:

a cylinder bank defining a compression cylinder;

a suction chamber in communication with said compression cylinder and with said inlet;

a discharge chamber in communication with said compression cylinder and with said outlet;

a capacity control system associated with said cylinder bank, said capacity control system comprising:

a valve body disposed between said inlet and said suction chamber, said valve body being movable between a first position where said inlet is in communication with said suction chamber and a second position where said inlet is prohibited from communicating with said suction chamber;

a control chamber disposed adjacent said valve body, pressurized fluid within said control chamber reacting against said valve body to move said valve body between said first and second positions;

a first valve disposed between said suction chamber and said control chamber, said first valve being open when said valve body is in said first position;

a second valve disposed between said discharge chamber and said valve body, said second valve being open en said valve body is in said second position; and an orifice disposed between said discharge chamber and said control chamber, said orifice limiting the flow of fluid between said discharge chamber and said control chamber to limit velocity of said valve body;

wherein said piston has a displacement of approximately 0.243 cubic inches and the diameter of said orifice ranges between 0.020 and 0.060 inches.

32. A compressor as claimed in claim 31 wherein the diameter of said orifice ranges between 0.030 and 0.050 inches.

* * * * *

UNITED STATES PATENT AND TRADEMARK OFFICE

CERTIFICATE OF CORRECTION

PATENT NO. : 6,575,710 B2
DATED : June 10, 2003
INVENTOR(S) : Frank W. Wallis

It is certified that error appears in the above-identified patent and that said Letters Patent is hereby corrected as shown below:

Column 4,
Line 39, “diameters” should be -- areas --.
Line 41, “diameters” should be -- diameter --.

Column 10,
Line 19, “en” should be -- when --.

Signed and Sealed this

Twenty-third Day of September, 2003

JAMES E. ROGAN
*Director of the United States Patent and Trademark Office*